United States Patent [19]

Lee

[11] 3,958,328

[45] May 25, 1976

[54] METHOD OF MAKING A TRANSFORMER COIL ASSEMBLY

[75] Inventor: Harold E. Lee, Logansport, Ind.

[73] Assignee: Essex International, Inc., Fort Wayne, Ind.

[22] Filed: June 2, 1975

[21] Appl. No.: 582,664

[52] U.S. Cl. ..... 29/605; 29/416; 29/418; 242/118.41; 336/198; 336/208

[51] Int. Cl.[2] ..... H01F 41/06

[58] Field of Search ..... 29/605, 602, 416, 418; 336/198, 208; 242/118.41, 118.5

[56] References Cited

UNITED STATES PATENTS 3,594,898 7/1971 Lewandowski ..... 29/418

3,652,968 3/1972 Johnston et al..... 336/208

*Primary Examiner*—Carl E. Hall

*Attorney, Agent, or Firm*—Robert D. Sommer; Lawrence E. Freiburger

[57] ABSTRACT

A method for making a coil assembly of the telescoping bobbin type wherein axially spaced coils are wound on an elongate tubular form comprising two spool-like bobbin sections integrally joined to each other in end-to-end relation by thin rupturable webs. The core of one bobbin section has an opening therethrough sized to receive the flanges of the other bobbin section. After winding of the coils is completed, the bobbin sections are axially pressed toward each other to rupture the rupturable webs and telescope one bobbin section into an opening of the other.

2 Claims, 3 Drawing Figures

METHOD OF MAKING A TRANSFORMER COIL ASSEMBLY

BACKGROUND OF THE INVENTION

This invention relates in general to transformer coil assemblies having concentrically wound coils, and more particularly to a method of making such coil assemblies.

Small transformers used for power supplies, control systems and other various purposes are commonly constructed with concentric primary and secondary coils wound on concentrically arranged bobbins which are assembled with a laminated magnetic core. Examples of transformer coil assemblies employing such a telescoped bobbin arrangement may be found in Klatte et al. U.S. Pat. No. 3,403,366 and Johnston et al. U.S. Pat. No. 3,652,968, disclosures of which are incorporated herein by reference. In the past, coil assemblies of this telescoped bobbin construction have been more costly than desired in that they required several independent fabricating steps such as molding of the bobbins, winding of the coils on the bobbins, forming or attaching leads for the coils, and assembly of one bobbin into another. It is obvious that the separate bobbin molding operations, the separate coil winding operations and other fabricating steps with multiple handlings of the bobbin are time consuming and costly.

SUMMARY OF THE INVENTION

It is therefore an object of this invention to provide an improved method for making a transformer coil assembly of the telescoping bobbin type which avoids the multiple time consuming and costly operations of the prior manufacturing methods.

It is a further object of this invention to provide a method of making a transformer coil assembly with better efficiency of manufacture than by prior manufacturing methods.

The foregoing objects are accomplished by winding axially spaced coils on an enlongate tubular form comprising two spool-like bobbin sections integrally joined to each other in end-to-end relation by thin rupturable webs. Preferrably, the coil form is placed on a fixed position mandrel for sequentially winding coils on the integral bobbin sections by using equipment commonly known as a fly-winder. After the coil winding step is completed, one bobbin section is axially pressed toward the other to rupture the webs and to telescope one bobbin section into an axial opening in the other. This telescoping operation may be performed while the form remains on the winding mandrel or after removal of the form from the mandrel. The present invention also contemplates placing the coil form on a rotatable mandrel and sequentially winding coils on the two bobbin sections.

BRIEF DESCRIPTION OF THE DRAWINGS

For a fuller understanding of the present invention, reference is made to the following detailed description and the accompanying drawings in which.

DETAILED DESCRIPTION OF THE INVENTION

Figure 1:
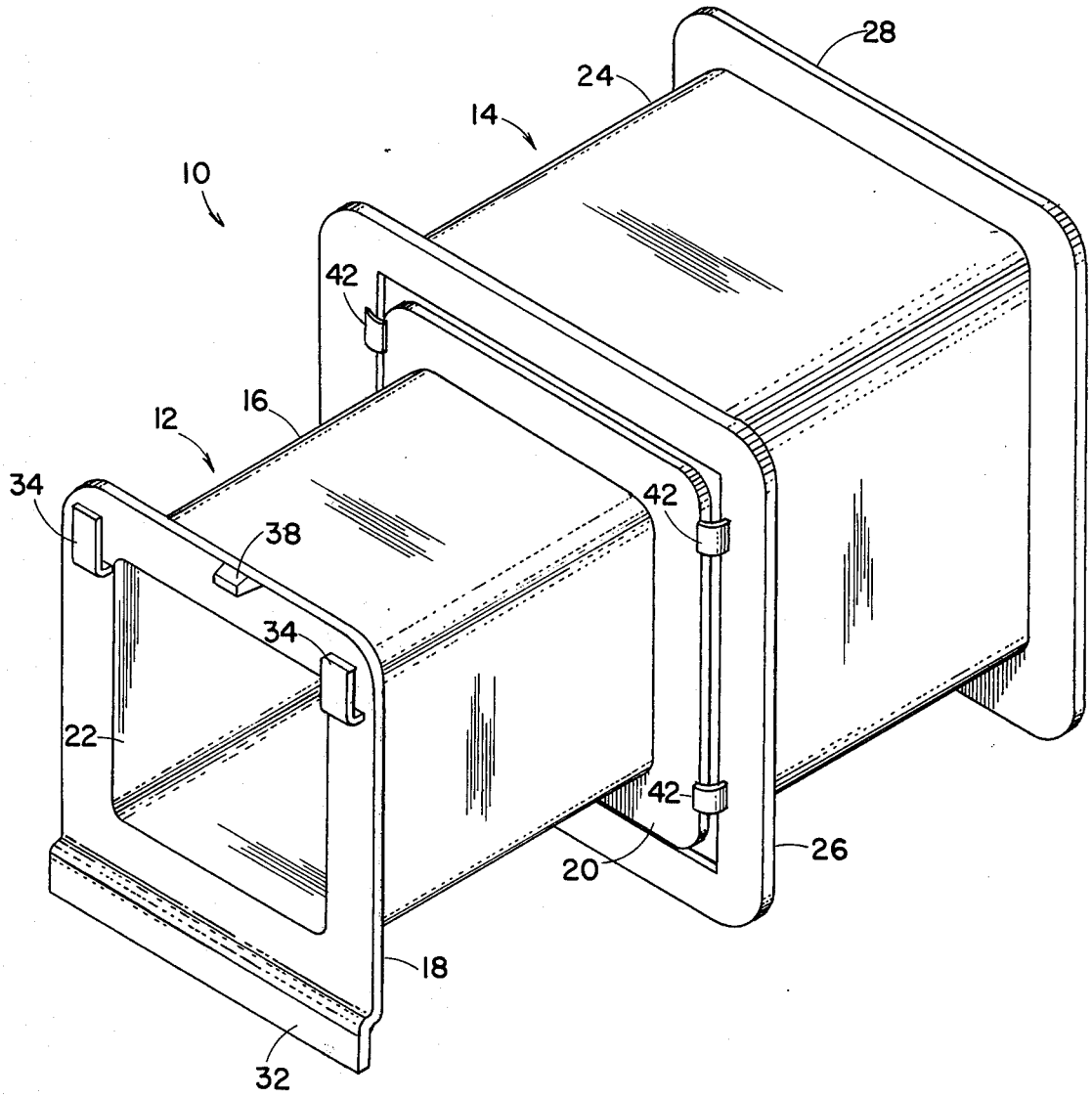
FIG. 1 is an isometric view of a coil form constructed according to the teachings of the invention.
Figure 2:
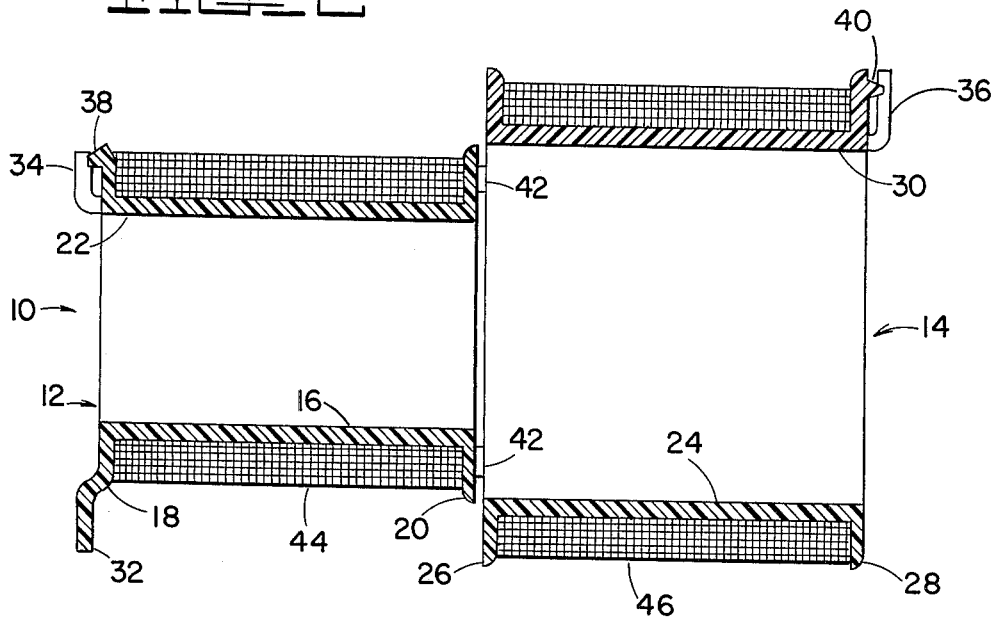
FIG. 2 is a cross-sectional view of the coil form shown in FIG. 1 including two coils wound respectively on the individual bobbin sections of the coil form.
Figure 3:
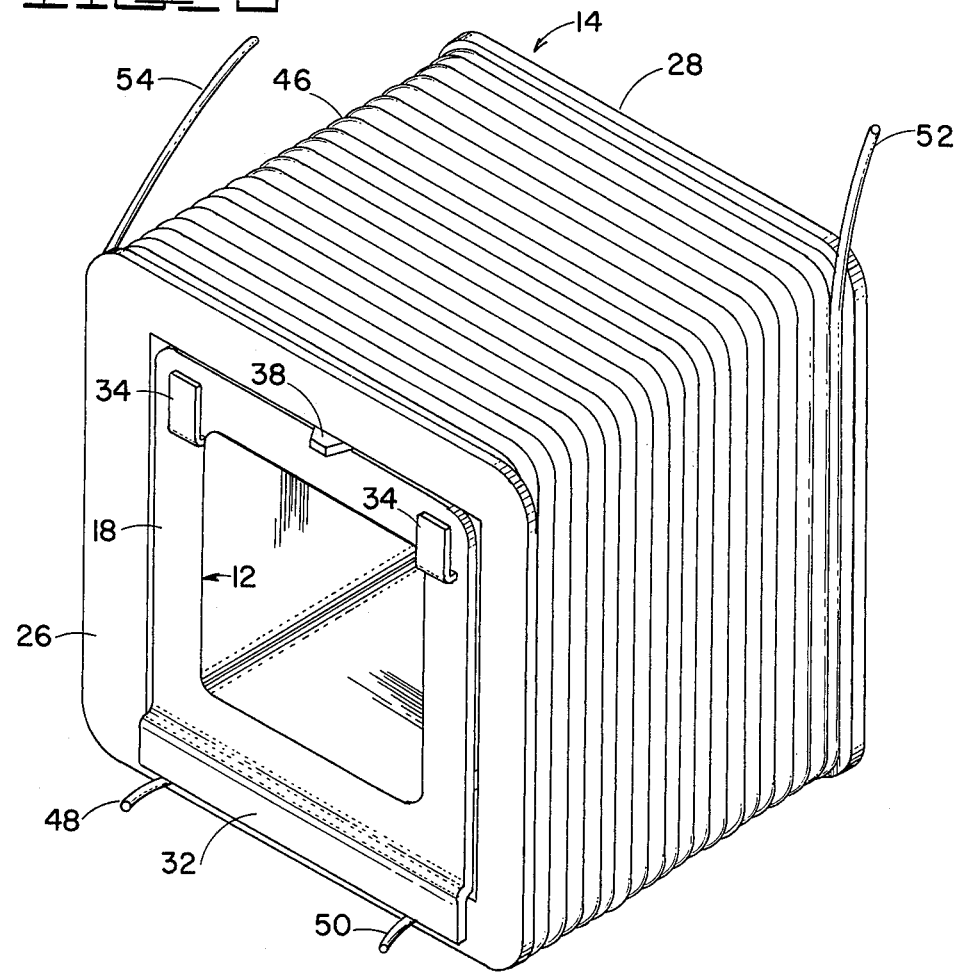
FIG. 3 is an isometric view of the coil assembly shown in FIG. 2 showing the bobbin sections in assembled relation.

Referring now to the drawings, FIG. 1 shows an elongate tubular form 10 which is employed in the method of making a transformer coil assembly according to the present invention. The coil form 10 is molded of a suitable electrical insulation material such as a glass filled nylon and comprises a first spool-like bobbin section 12 and a second spool-like bobbin section 14. The bobbin section 12 includes a core 16 of substantially hollow rectangular configuration and a pair of rectangular or square flanges 18, 20 extending outwardly from the ends of the core 16. The core 16 has an opening 22 which extends between its ends for receiving the leg portion of a magnetic core (not shown). In like manner, the second bobbin section 14 has a core 24 of substantially hollow rectangular configuration and a pair of rectangular or square flanges 26, 28 extending outwardly from the ends of the core 24. The core 24, has an opening 30 which extends between its ends and which is sized to receive the flanges 18, 20 of the bobbin section 12 when the bobbin sections are telescoped in final assembled relation as shown in FIG. 3. A tab 32 may be provided which is integral with flange 18 of bobbin section 12 and which is slightly offset from the plane of flange 18. The purpose of tab 32 will become evident from the ensuing discussion but it should be noted that it performs a twofold function; to maintain the lead wires of the coil of wire wound on bobbin section 12 in place during the final assembly and to limit the extent of movement of bobbin section 12 into core opening 30.

The L-shaped anchors 34 are integrally formed on the outer surface of flange 18. Similiar anchors 36 are formed on the outer surface of flange 28. Flange 18 also has an outwardly extending projection 38 that cooperates with a similiar projection 40 on the flange 28 and anchors 34 and 36 to position and retain a leadwire supporting insulator (not shown).

The coil form 10 is molded as one piece with the flange 20 of the bobbin section 12 joined to the core 24 of the bobbin section 14 by thin rupturable webs 42. While the webs are sufficiently thin so that axial pressing of one bobbin section toward the other can easily break the webs and completely sever the bobbin sections, the integral connection of the bobbin sections is sufficiently rugged to permit the winding of coils on the bobbin sections with conventional coil winding equipment.

In practicing the method of the present invention, the tubular form 10 is produced by an injection molding process or by any other appropriate process. Since the bobbin sections 12, 14 are in end-to-end relation with their respective longitudinal axes generally in alignment, the form 10 is readily molded using only slightly more material than that required for a corresponding set of independently molded bobbins. It is also important to note that since the two bobbin sections are molded integrally with one another, relative dimensions between one another, are important. However, in contrast to the prior art where the bobbin sections are molded separately, it is not necessary to hold tolerance as close with the tubular form 10 as opposed to molding the bobbin sections separately.

The next step of the method is to wind the respective coils 44 and 46 of insulated wire upon bobbin sections 12 and 14. Preferrably, the bobbin sections are wound by a fly-winder having a spindle or mandrel carrier or table which is indexed through a plurality of positions and which has a winding head mounted at two of the positions. Such a machine is the Mark V Automatic Sequential Winder available from Possis Machine Corporation of Minneapolis, Minnesota. In accordance with the present invention, the tubular form 10 is placed upon the spindle or mandrel of the rotatable table with the larger bobbin section 14 located at the innermost position on the mandrel. The rotatable table is then indexed to the first winding position at which the first fly-winder head places wire on the bobbin section 14 until the desired number of turns have been placed thereon to form a coil designated by reference numeral 46. The table is then indexed to a second position at which the second fly-winder head places wire on the bobbin section 12 until the desired number of turns have been placed thereon to form a coil designated by reference numeral 44. Of course, at the same time the second winding head is placing wire on bobbin section 12 at the second station, the first winding head is placing wire on the bobbin section 14 of the next tubular form 10 to be wound. It will be evident to those skilled in the art that while wire is being placed on bobbin section 12 at the second station, the coil 46 located on bobbin section 14 of the tubular form 10 located at the second winding station will be connected to the wire being placed on bobbin section 14 at the first station. After the coil 44 on bobbin section 12 is completed at the second station, the table is indexed to the next station, at which time the lead wires to coils 44 and 46 may be severed. While the tubular form 10, with completed coils 44 and 46 thereon, is still positioned on the mandrel, bobbin sections 12 and 14 are urged toward one another to break the frangible webs 42 and telescope bobbin section 12 into opening 30 within bobbin section 14. The lengths of cores 16 and 24 are substantially equal such that the bobbin sections with their respective coils are concentrically disposed when tab 32 on flange 18 of bobbin section 12 engages flange 26 of bobbin section 14. Tab 32 on flange 18 also entraps the start end 48 and the finish end 50 of coil 44 between the tab 32 and flange 26 to hold these leads in place.

It will be evident to those skilled in the art that after the coil 44 has been wound upon bobbin section 12 it is not necessary to sever the wire connecting coil 46 with subsequently wound coils 46 and the wire connecting coil 44 with subsequently wound coils 44 prior to telescoping the two bobbin sections together. Also, it will be evident that the telescoping and severing operations may be performed after the wound forms 10 have been removed from the mandrels on the fly-winding machine, if desired.

It would be noted at this point that coils 46 and 44 may be sequentially wound upon the coil form 10 by mounting the coil form 10 on a rotating mandrel and rotating the mandrel to wind the wires on bobbin sections 14 and 12, respectively. In addition, it should be noted that more than one such form 10 may be placed on the rotatable mandrel. When this is done, the mandrel may be rotated and all bobbin sections 14 wound simultaneously, each one from a separate wire source. Then, the wires may be severed and the lead wires of coil 46 fixed in place. Then the bobbin sections 12 may be wound simultaneously in the same manner to provide the desired number of turns thereon. Alternately, the bobbin sections 14 may be sequentially wound from the same wire source, the connecting wires severed, and the bobbin sections 12 wound in the same manner.

After telescoping of the bobbin sections 12 and 14, various conventional finishing operations may be performed on the resulting coil assembly. The wire ends 48, 50 of the coil 44 may be tinned and the wire ends 52, 54 of the coil 46 may be soldered to leads sutiably attached to a supporting insulator that may be subsequently secured to the coil assembly. A conventional magnetic core of E and I laminations may then be assembled about the coil assembly to provide a complete transformer.

It will be seen from the foregoing disclosure that the method according to the present invention enables the efficient and economical manufacture of coil assemblies of the telescoping bobbin type. It will be appreciated that such coils may be used not only in transformers but in other devices where coils wound on concentrically arranged bobbins are desired.

Certain modifications of the illustrated embodiment will be evident to those skilled in the art. It is intended that the appended claims define the present invention broadly enough so as to cover these modifications.

What is claimed is:

1. The method of making a coil assembly which comprises:

providing an elongate tubular form comprising first and second spool-like bobbin sections each having a core with an opening through the core of the second bobbin section being sized to receive the flanges of the first bobbin section, said first and second bobbin sections being in end-to-end relation with their respective longitudinal axes generally in alignment and with one flange of said first bobbin section integrally joined to one end of the core of said second bobbin section by thin rupturable webs;

winding a coil of insulated wire on at least said first bobbin section while said first and second bobbin sections remain connected by said rupturable webs; and axially pressing one bobbin section toward the other bobbin section to rupture said rupturable webs and telescope said first bobbin section in said second bobbin section.

2. The method as set forth in claim 1 including the winding of a coil of insulated wire on said second bobbin section while said first and second bobbin sections remain connected by said rupturable webs.

* * * * *